US010392238B2

(12) United States Patent
Lawler et al.

(10) Patent No.: US 10,392,238 B2
(45) Date of Patent: Aug. 27, 2019

(54) METHOD AND SYSTEM FOR CLEANING BEVERAGE DISPENSING SYSTEMS

(71) Applicant: QualFlow Systems Limited, Dublin (IE)

(72) Inventors: Justin Lawler, Dublin (IE); Ciaran O'Morain, Dublin (IE)

(73) Assignee: QualFlow Systems Limited, Dublin (IE)

( * ) Notice: Subject to any disclaimer, the term of this patent is extended or adjusted under 35 U.S.C. 154(b) by 0 days.

(21) Appl. No.: 15/054,576

(22) Filed: Feb. 26, 2016

(65) Prior Publication Data

US 2016/0176693 A1 Jun. 23, 2016

Related U.S. Application Data

(63) Continuation-in-part of application No. PCT/EP2014/068196, filed on Aug. 27, 2014.

(30) Foreign Application Priority Data

Aug. 28, 2013 (GB) ..... 1315302.8

(51) Int. Cl.
*B67D 1/07* (2006.01)
*B67D 1/12* (2006.01)

(52) U.S. Cl.
CPC ..... *B67D 1/07* (2013.01); *B67D 1/1277* (2013.01)

(58) Field of Classification Search
CPC ... B08B 9/0321; B08B 9/0323; B08B 9/0325; B08B 9/0328; B67D 1/07; B67D 1/1277
See application file for complete search history.

(56) References Cited

U.S. PATENT DOCUMENTS 1,866,870 A 7/1932 Uroukoff
2,018,952 A * 10/1935 Erdmann ..... B08B 9/0323 134/168 C
2,039,006 A 4/1936 Jasper
2,098,525 A * 11/1937 Smith ..... B08B 9/0323 134/103.1
2,175,951 A * 10/1939 Bulleri ..... B08B 9/0323 134/103.1
2,189,448 A * 2/1940 McCrory ..... B67D 1/16 137/207.5
2,371,188 A 3/1945 Russell
2,443,550 A * 6/1948 Zwosta ..... B08B 9/0323 137/208
RE27,626 E * 4/1973 Johnston ..... B67D 1/0832 222/400.7
3,771,177 A * 11/1973 Rogers ..... A47K 1/14 4/287
4,779,761 A * 10/1988 Rudick ..... B67D 1/0027 222/1
5,988,859 A * 11/1999 Kirk ..... B67D 1/06 222/30

(Continued)

FOREIGN PATENT DOCUMENTS

WO 02/33302 4/2002

*Primary Examiner* — David P Angwin
*Assistant Examiner* — Bob Zadeh
(74) *Attorney, Agent, or Firm* — McCracken & Gillen LLC

(57) ABSTRACT

The present application relates generally to a system which provides for cleaning of beverage supply lines and fittings. More particularly, the system provides for equalizing of flows and pressures between parallel beverage lines being cleaned.

19 Claims, 7 Drawing Sheets

(56) References Cited

U.S. PATENT DOCUMENTS

| | | | | |
|---|---|---|---|---|
| 6,287,515 | B1 * | 9/2001 | Koosman | A61L 2/183 422/186.07 |
| 6,470,514 | B2 * | 10/2002 | Onoue | E03C 1/23 4/688 |
| 7,311,224 | B2 * | 12/2007 | Emmendoerfer | B08B 9/0325 137/240 |
| 7,717,294 | B2 * | 5/2010 | Bodemann | B67D 1/0878 222/1 |
| 8,663,724 | B1 * | 3/2014 | Banasik | A47J 31/0631 426/431 |
| 2001/0052150 | A1 * | 12/2001 | Onoue | E03C 1/23 4/689 |
| 2004/0245281 | A1 * | 12/2004 | Oke | A61L 2/16 222/1 |
| 2006/0196727 | A1 * | 9/2006 | Shields | B62D 55/092 184/29 |
| 2008/0223410 | A1 * | 9/2008 | Molloy | B08B 9/0323 134/22.11 |
| 2009/0255595 | A1 * | 10/2009 | Roche | F17D 1/20 137/565.15 |
| 2010/0243676 | A1 * | 9/2010 | Bax | B08B 9/0552 222/148 |
| 2013/0341363 | A1 * | 12/2013 | Scott | B67D 1/1252 222/396 |

* cited by examiner $4_1$
8
26
17
$4_g$
8
5
7
$2_b$
3
9
11
18

METHOD AND SYSTEM FOR CLEANING BEVERAGE DISPENSING SYSTEMS

PRIORITY CLAIM

The present application claims benefit to and is a continuation-in-part application of PCT Application No. PCT/EP2014/068196 having a filing date of 27 Aug. 2014, which in turn claims priority from United Kingdom Patent No. GB1315302.8 filed 28 Aug. 2013, the entire contents of each application are hereby incorporated by reference as if fully set forth herein.

FIELD OF THE APPLICATION

The present application relates generally to beverage dispensing systems and more particularly to methods of cleaning them.

BACKGROUND

Systems for dispense of beverages can be considered to consist of three main parts. The first part is a storage container or reservoir for storing the beverage. These storage containers when used in the context of alcoholic drinks, for example beer, are often referred to as a keg. These kegs are typically located in a storage area, cold room or cellar. Secondly a beverage transport system is used to convey the beverage to a dispense location, for example a bar, through pipes or lines. Thirdly, a dispenser commonly referred to as a tap, delivers beverage from the pipes\lines into a container, e.g. a glass, for consumption. Although usage varies, pipes are generally rigid whereas lines are taken to be flexible. In practise, a system may employ a combination of both. In the present application, the term conduit is employed and may be taken to include both rigid pipework and flexible lines or hoses.

A beverage dispensing system may also have additional components for example to cool the beverage and provide insulation of the cooled beverage in the dispense lines as the beverage is conveyed to the dispenser. Installations of beverage dispensing systems vary but a common installation might typically position the beverage storage containers in a chilled storage area or cellar. The beverage may then be additionally cooled in proximity to the storage area before being transported to the dispense location.

Alternative installations may provide the additional cooling of the beverage in proximity to the dispense location. Another possibility is to not use a chilled storage area but to transport the beverage from the storage container at ambient temperature before cooling the beverage in proximity to the dispense location.

FIG. 1 shows an exemplary beverage dispense system. The beverage dispense system comprises beverage storage containers 1, located in a beverage storage area, cold room or cellar 2. The beverage transport system typically comprises a number of beverage conduits 5 which may be a combination of pipes or hoses, FOB detectors 3 and one or more beverage chillers 7.

Each beverage conduit 5 is connected to a corresponding storage container by a connector 14, commonly referred to as a "dispense head" for carbonated beverage products. Other components may be included as required by the application or specific installation. The beverage lines\pipes may be insulated in regions 6 in order to maintain the temperature of the beverage during its time in the transport system. Beverage is served from a beverage tap 8 in a remote location, i.e. a bar area 4.

Beverages are typically dispensed from the storage container by means of gas pressure which pushes the beverage out of the container and into the beverage dispense lines. The beverage containers are configured so that liquid is dispensed from the bottom of the container so the addition of pressurised gas above the level of the liquid forces the beverage out of the container. Gas enters the storage container through the dispense head 14 and is supplied from a source of pressurised gas 15 through a gas delivery conduit 16. Additionally pumps may be used to pump the beverage through the beverage dispense lines. Some beverages which do not use gas pressure may only use pumps to draw beer from the container to the beverage tap.

As storage containers empty, gas can enter the beverage dispense line and potentially travel up the line to the dispenser. For beverages which are carbonated i.e. contain dissolved gas, this can result in loss of beer due to the formation of foam or FOB (foam on beer) when beverage is reintroduced into the dispense line. FOB is unsuitable for consumption and is therefore wasted. To stop this occurring beverage lines are typically fitted with a device to stop gas ingression into the beverage dispense lines. These devices are commonly referred to as FOB detectors and typical examples include UK patents GB1,357,953 or Porter Lancastrian, GB2,286,581 of Francisco Moreno Barbosa and U.S. Pat. No. 5,564,459. They are typically configured as a liquid filled chamber that is positioned near the start of the beverage dispense line. Beverage enters the chamber near the top and exits near the bottom of the fob detector. A buoyant float in the chamber rises to the top when the chamber is filled with liquid and lowers as the liquid level drops when gas is introduced. As the liquid level drops the float drops into and seals a valve of the chamber preventing further gas ingress into the beverage dispense lines. Other fob detectors are known which operate indirectly. These indirect fob detectors use a sensor to determine the position of the float in the chamber and actuate a separate valve, to control the flow of beverage when the position of the float has been detected as having fallen to a particular level. UK patent GB2,404651 is an example of this system.

In some arrangements the beverage conduit splits to connect multiple taps to the same dispense head. Typically this is done downstream of the FOB detector. In this way one beverage storage container can supply a plurality of taps in different dispense areas.

It will be appreciated that in operation at any one time, the transport system for delivering beverages from the beverage storage container to the tap will contain a volume of beverage liquid. The volume of liquid incorporates the beverage resident in the beverage lines, the beverage cooler and the FOB. This liquid is in contact with the internal surfaces of the transport system.

Some beverages are shipped in storage containers as a sterile product to increase their storage life. Others are "live" (i.e. un-pasteurized or not sterile filtered) and contain yeasts from the brewing process. The beverage transport system is generally open (i.e. not sealed from its external environment) and there is the potential for ingress of yeasts and bacteria through the inlet where it is connected to the beverage storage container and at the outlet through the beverage tap. Additionally the flow of liquid through the transport system can distribute contaminating organisms throughout the rest of the transport system. While some of these are suspended in the liquid, others settle and grow on the surfaces of the transport system to form biofilm. The rate of growth of yeasts and bacteria is dependant on a number of factors including temperature, material type and surface roughness etc.

If the growth of yeasts and bacteria is sufficiently large it can produce unsavoury and off flavours in the dispense product, making it unsuitable for consumption. Therefore the transport system and beverage tap require regular cleaning to remove the biofilm growth and ensure the quality of the dispense product. During such cleaning processes, detergent fluids are typically flushed through the transport system and tap and then any residual detergent is rinsed away with potable water. Cleaning of the transport system does not produce sterile standards of contamination given the open nature of the dispense system. Instead, the aim is to remove and reduce the biological growth to levels where re-growth does not impact dispensed product quality between cleaning cycles.

There are a number of approaches taken to cleaning the beverage transport system. Typically detergent solution is introduced and dispensed through the transport system in a similar manner to beverage dispense. This is subsequently removed from the system by rinsing with water. There are numerous processes used for cleaning the transport system with varying parameters such as time, detergent type and concentration, flowing or static detergent exposure, the use of rinse water before as well as after detergent introduction. However the majority of processes include a process of filling the transport system with detergent, a static or "soak" period and its subsequent removal by flushing with rinse water. Introduction of the detergent may be performed sequentially into the transport system beverage conduits or in parallel, i.e. one conduit may be done after another or they may be done at the same time.

FIG. 1 includes an exemplary automated cleaning system 10. The system is connected to a water supply 12. The system is also connected to a source of concentrated cleaning detergent 13. The cleaning system in this example provides dilute detergent solution and rinse water to a common manifold 11 commonly referred to as a "cleaning ring main". On the cleaning ring main there are outlet connectors 9 commonly referred to as "cleaning sockets". The cleaning ring main may take a number of configurations including a single line with one inlet, equally it may be configured to form a loop so that detergent solution and rinse water is provided from either end. For cleaning, the dispense head is removed from the storage container and connected to a cleaning socket. Detergent solution and rinse water may then enter the beverage conduit 5. The configuration shown in FIG. 1 is exemplary and one that is used commonly in practice to somewhat automate the supply of mixed detergent and rinse water. Other configurations are possible and are used in practice. Further components may be used to additionally automate the cleaning process (e.g. a drainage system from the beverage tap). Still further features may be included to ensure process conformance by monitoring time, sensor data etc and this may be recorded for future use. The process may also be performed manually by mixing the detergent solution and providing a pump to deliver it to the beverage conduits.

Different configurations are possible, thus in FIG. 2, the dispense conduits are connected to a source of line cleaning solution 18 through a common inlet manifold or "cleaning ring main" 11. The taps are connected by drainage lines 26 to a wastewater drain 17.

Methods to improve and automate the cleaning process have taken a number of approaches. Examples of automation include U.S. Pat. Nos. 2,098,525, 2,016,926 and 4,572,230. Some alternatives use a mechanical device or "squeegee" reciprocally moving up and down the beverage conduits (e.g. U.S. Pat. Nos. 2,827,070, 2,413,626 and 2,331,460). Still other methods pulse the flow of the detergent solution in the transport system to help remove the biofilm growth from the surfaces (e.g. U.S. Pat. No. 8,069,866 and GB2,414,284A).

One aim of using automation has been to enable multiple beverage conduits to be cleaned during one cleaning event and reducing manual intervention. Methods taking this approach use valves to control the flow of detergent into, or out of, the transport system beverage conduits to ensure that they are correctly filled with detergent and subsequently rinsed (e.g. U.S. Pat. No. 5,090,440 and US2006/0097008). This allows sequential cleaning of the lines with less manual intervention. Other systems use additional sensors (e.g. PH, optical) and drainage systems from the beverage tap in combination with valves to further automate the process. Examples include US2008/0223410 and GB2488777A. The disadvantage of this level of automation is the increased cost and complexity associated with the additional components.

Cleaning of the beverage conduits may be considered to be conducted in two ways. Firstly by sequentially filling individual or a subset of beverage conduits with cleaning solution until all the conduits are filled and repeating the process for rinsing. A serial example of this involves an operator opening a beverage tap until detergent exits the tap and closing the tap before opening another tap. A similar process is used for rinsing the detergent. The second method is to fill all the conduits in parallel with flowing detergent and similarly rinsing same. This is faster and requires less manual intervention or automation than sequential cleaning. Parallel cleaning is typically used in combination with some form of drainage system with one end connected to the outlet of the dispense taps and the other end to a wastewater drain for disposal of the liquid. All dispense taps are typically open for the duration of the cleaning and rinsing process.

Unfortunately, whilst performing the cleaning process in parallel is faster, it is not practical to do so in all locations and even where it is used the performance of the cleaning process may be significantly different between conduits. For example, because of varying line lengths and heights, the time required for detergent to reach a tap can vary considerably between conduits. Similarly, different conduits can have different flow rates when connected in parallel with the net result that the cleaning process is less than ideal for some of the conduits.

One way of addressing these problems is by use of an outlet manifold incorporating valves, sensors and a controller to ensure individual dispense conduits are completely charged with detergent solution. An example of this type of solution is exemplified by US2008/0223410. This type of solution adds significant complexity and cost, particularly if multiple beverage conduits are to be cleaned in different locations at the same time.

The present application is directed at providing a solution for the efficient and effective cleaning of beverage dispense lines in parallel.

SUMMARY

Accordingly, the present application provides a drainage conduit for use in cleaning a beverage dispensing system as might be found in a bar, hotel or restaurant. The drainage conduit comprises an inlet provided at one end for connecting to an outlet of the beverage dispensing system, which is suitably a beer or other beverage tap.

An outlet is provided at an opposite end of the conduit to the inlet. A pressure equalising feature is provided between the inlet and the outlet. The pressure equalising feature is suitably a pressure actuated valve. The valve is configured to open at a preset pressure to provide fluid communication between the inlet and the outlet.

For convenience, the inlet is configured to engage with corresponding features of the outlet in the beverage dispensing system. In doing so the connection may be one of a screw fit, a push fit, or a snap fit.

Desirably although not essential, the valve is a one way valve preventing liquid flow from the drainage conduit outlet to the drainage conduit inlet.

To facilitate ease of discharge, the drainage conduit outlet is configured for connection to one of a drain or a receptacle. Equally, the drainage conduit may simply be placed in a sink for discharging liquid.

In one arrangement, the drainage conduit is a flexible tube having an inner bore and the valve is disposed within said bore.

In use, a plurality of the drainage conduits are employed in a cleaning system, each one being used with a separate beverage dispensing tap. To allow for ease of set-up, the drainage conduits may be each be marked to distinguish drainage conduits with different preset pressure values.

A cleaning system using the drainage conduits suitably also provides a source of cleaning solution which may be connected to the opposite end of the beverage conduit as the beverage dispensing tap. To allow for automation of the cleaning process, a flowmeter may be provided for measuring the amount of cleaning solution or rinse that has entered the beverage lines and a controller for controlling the operation of the cleaning system using measurements from the flowmeter.

Where the arrangement is used across different levels in a premises, there may be a first group of drainage conduits comprise valves configured to open at a first preset pressure and a second group of drainage conduits comprise valves configured to open at a second preset pressure. This is to account for differences in height between the taps to which both sets are connected. It may also be used to account for differences in the length of beverage conduits.

The application also provides a method for cleaning a beverage dispensing system, where the beverage dispensing system is of the type comprising a plurality of beverage dispensing conduits, each conduit providing beverage from a source to a dispenser. The method suitably comprises connecting a pressure actuated valve to at least one dispenser to equalise the pressure between the taps. The method further comprises connecting a source of cleaning solution to each beverage dispensing conduit at the opposite end to the dispenser; and opening each dispenser.

Another aspect of the present application is the inclusion of the pressure equalising feature within the beverage dispensing system, suitably adjacent to or within the dispensing tap. Thus, the application provides a beverage dispensing tap comprising an inlet for receiving beverage from a source and an outlet for dispensing the beverage and further comprising a valve positioned between the inlet and outlet and being configured to open at preset pressure. Similarly, the application provides a beverage line for communicating beverage from a source to a dispensing tap, wherein the beverage line includes a pressure equalising feature. More particularly, the present application provides for beverage dispensing conduit comprising an inlet for receiving beverage from a source and an outlet for connecting to a dispensing tap and where the beverage dispensing conduit further comprises a valve positioned between the inlet and outlet and being configured to open at a preset pressure.

It will be appreciated that the valve employed to equalise pressure is separate from any valve or switch the user might operate to dispense liquid as otherwise the tap would flow whenever connected to a source of beverage under pressure.

The application also provides for a portable alarm device for use with a beverage cleaning system. The portable alarm device includes a timer and an alarm, wherein the alarm is activated after a predetermined time set by the timer in response to a triggering event, and wherein the alarm is removable from the beverage cleaning system and the triggering event is the detection of the removal of the portable alarm from the beverage conduit cleaning system. The portable alarm device may further comprise a sensor for detecting the removal of the portable alarm from the beverage conduit cleaning system.

Further embodiments are set out specifically in the claims, which follow. Additional embodiments, features and advantages will become apparent from the detailed description and the drawings which follow, in which:

DESCRIPTION OF DRAWINGS

For convenience, the same reference numerals are used with like features between the figures in the drawings.

DETAILED DESCRIPTION

The inventor of the present invention has realised that a problem with parallel cleaning of multiple beverage conduits in the transport system is the variation in flow resistance or backpressure experienced between different conduits. Flow resistance is influenced by a number of factors including hydrostatic pressure, liquid velocity, length, diameter and surface roughness of the conduit, density and viscosity of the liquid. Beverage conduits start at the storage area or cellar but may be of varying lengths and diameters, and terminate at different locations and heights above or below the storage area. If beverage conduits are being filled in parallel i.e. from a common inlet manifold, these varying parameters result in variations in the flow rate of detergent fluid and rinse water through different beverage conduits. To ensure that the beverage conduits are completely filled with detergent solution and subsequently rinsed thoroughly, the process must flow detergent or rinse water until the beverage conduit with the highest flow resistance (i.e. slowest liquid flow) is complete. In addition when flow of detergent is stopped (e.g. during the soak period of the cleaning session) it can drain out of the beverage tap due to ingress of air from the drainage system. This results in parts of the surface not being exposed to detergent solution for the whole duration of the cleaning session. The taps are a potential entry point for contaminants into the beverage conduit and are therefore more likely to have a higher level of microbial contamination. Incomplete cleaning of this part of the beverage conduit can result in beverage dispense quality problems.

Realising this, the present inventor provides a solution to the problem by substantially balancing the difference in flow resistance between different dispense conduits connected to a common cleaning manifold or cleaning ring main. This facilitates parallel cleaning of multiple beverage conduits at the same time.

The application will now be described with reference to some typical arrangements of beverage dispensing systems which may be found for example in a bar.

Figure 2:
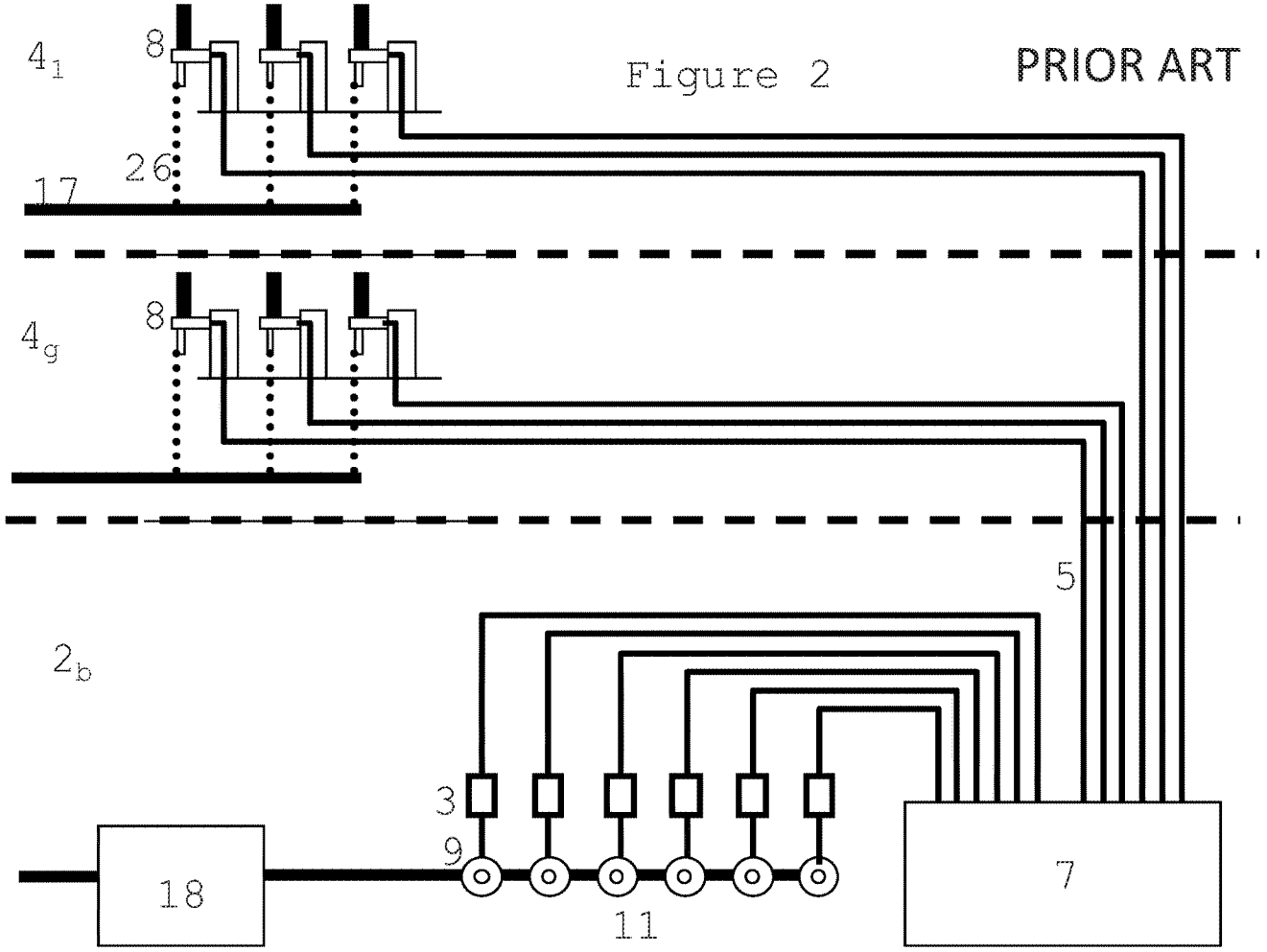
PRIOR ART Figure 2
FIG. 2 is an exemplary beverage dispense system known in the art for supplying beverage from a storage area below two separate bar areas on different levels.
Figure 3:
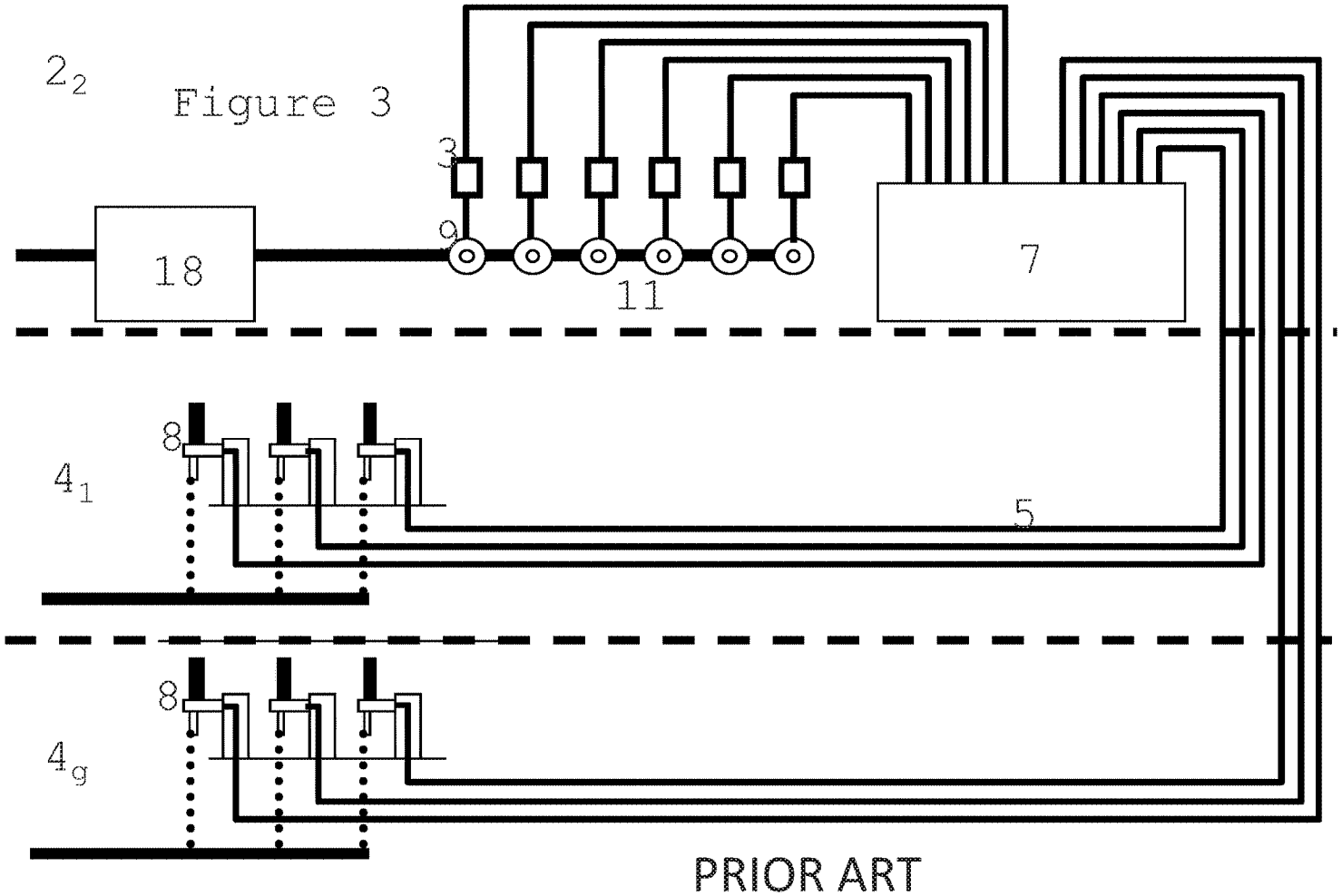
FIG. 3 is an alternative configuration to FIG. 2 in which the storage area is above the bar areas.

More specifically, FIGS. 2 and 3 show two examples of potential configurations used in parallel cleaning. In FIG. 2 a basement storage area or cellar $\mathbf{2}_b$ supplies beverage to two dispense areas commonly bars, $\mathbf{4}_g$ on the ground floor and $\mathbf{4}_1$ on the $1^{st}$ floor. The beverage tap 8 is connected by a drainage hose or tube 16 to a wastewater drain 17. The wastewater drain may be a sink drain or it may be a dedicated receptacle for the storage of the solution to facilitate subsequent disposal. A cleaning solution, which may be a detergent solution or rinse water or both is supplied from a source 18 to the common manifold 11. When the source of cleaning solution is connected, it attempts to flow through the different beverage conduits which are connected in parallel through the cleaning manifold.

However, the cleaning solution experiences different flow resistance between the various beverage dispensing conduits because of the different static head pressure and conduit dimensions between the manifold and the beverage tap. Typically flow will be higher through the ground floor beverage tap than through the $1^{st}$ floor. Additionally when flow stops during a soak period, liquid can potentially back flow from the conduits supplying the $1^{st}$ floor beverage tap out through the ground floor beverage tap. FIG. 3 shows an example of a $2^{nd}$ floor storage area $\mathbf{2}_2$, with dispense areas on the $1^{st}$ ($\mathbf{4}_1$) and ground floors ($\mathbf{4}_g$). In this case a negative hydraulic pressure head exists between the cleaning ring main and the beverage tap. Preferentially flow will be through the ground floor beverage tap even though the conduits may be longer. Additionally siphoning from $1^{st}$ to ground floor supply conduits may occur during soak periods when there is no flowing supply of detergent solution from the exemplary cleaning system. The exemplary situations presented in FIGS. 2 and 3 are also liable to detergent solution draining from the beverage tap when there is no flowing detergent.

There are many potential variations, accordingly the following description is for illustrative purposes and is not to be viewed in anyway as restrictive. Thus, for example, whilst the description which follows outlines the application to an exemplary beverage dispensing system, it will be appreciated that the system components and configuration may vary depending on the approach taken to dispense the beverage. Similarly, whilst the application is described in terms of an exemplary dispensing system comprising a plurality of different features and functions it will be appreciated that some of these features may be omitted or replaced and that the application is not to be construed as requiring all of the described features and functions unless stated as such.

The present application addresses the problems of the prior art by equalising pressures at each of the dispense taps. This allows for better cleaning in a parallel cleaning configuration, in which the dispense heads 14 of the beverage conduits 5 are connected to the cleaning sockets 9 of a common inlet manifold 11.

In this arrangement, a source of cleaning detergent solution and rinse water 18 supplies liquid to the inlet manifold as has previously been described with reference to the prior art.

Figure 4:
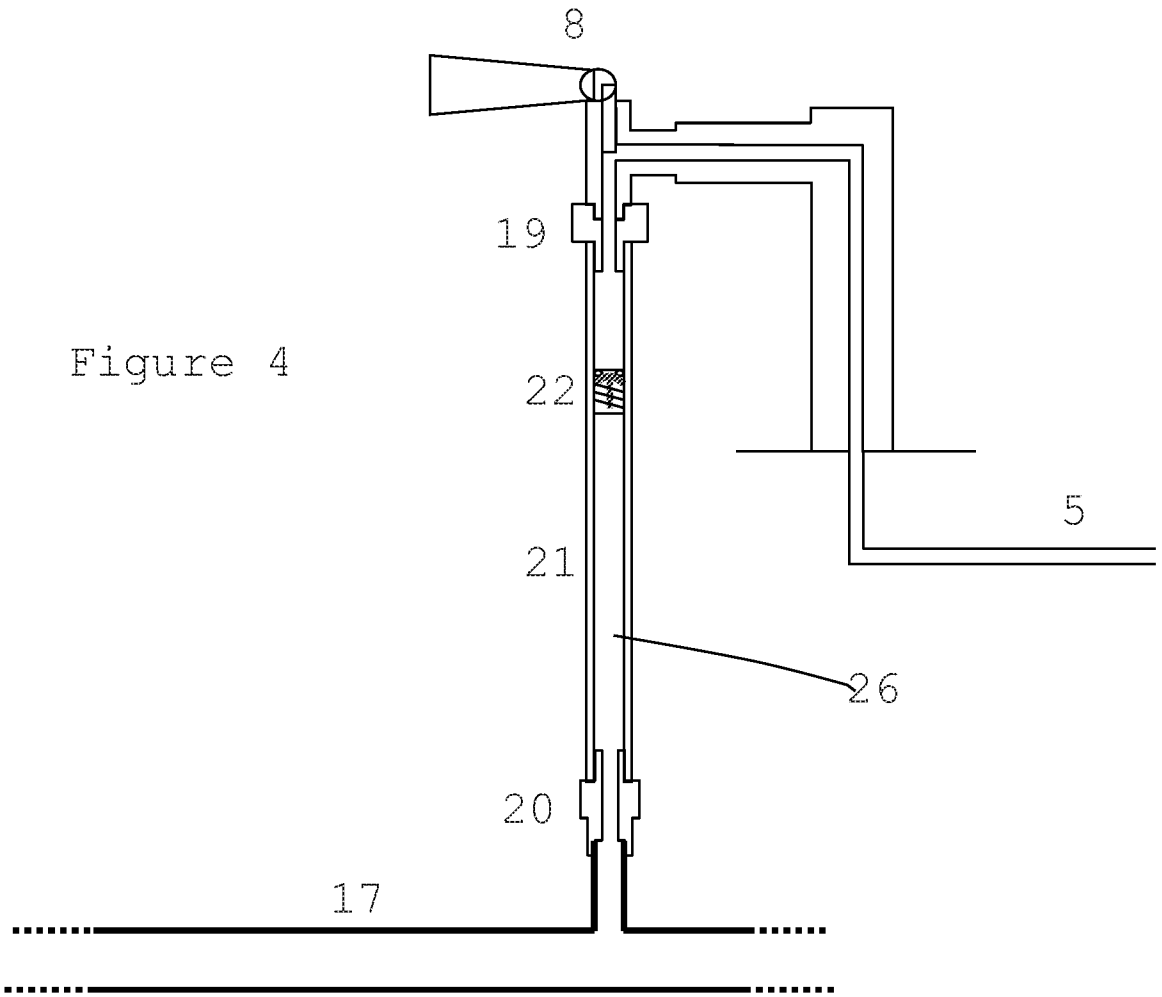
FIG. 4 is an exemplary drainage conduit according to an embodiment of the present application in which the pressure equalising feature is positioned in the drainage conduit.

However, the arrangement at the dispense taps is different. FIG. 4 is an exemplary drainage hose attached to an exemplary dispense tap. It will be appreciated that a drainage hose is specific for this purpose so as to reduce the risk of spillage. Such hoses are generally less than 3 m in length as they only need to connect the dispense tap to the sink or drain and the distances in a bar are generally short. Having anything longer would be an inconvenience. The drainage hose may also be generally transparent so that the user can see the liquid in the hose.

The drainage hose 26 has an inlet 19 which may be connected to the beverage tap 8 and an outlet 20 which may be connected to a wastewater drain 17, alternative storage receptacle or simply into a sink or drain. The drainage hose conduit 21 connects the inlet of the drainage hose to the outlet. A pressure equalising feature is provided along the conduit. The purpose of the pressure equalising feature is to equalise pressure between different dispense taps. The pressure equalising feature may be a valve.

In which case, the valve is suitably a one way valve preventing liquid flowing from the outlet toward the inlet of the drainage hose. To equalise the pressure across conduits connected to dispense taps, the actuating pressure of the valves are different. More specifically, the actuating pressures will be determined by reference to the difference in pressure at each tap. In practise, this may generally be taken to correspond to the difference in height between dispense taps. Thus a set of drainage hoses for use with dispense taps on one floor may have a first actuating pressure with a set of drainage hoses for use on a second floor having a second actuating pressure. In this scenario, the difference in actuating pressure between the two sets suitable corresponds to the difference in static pressures of the liquid between the two sets of dispense taps. In this way the valves will open at the same time and under the same actuating conditions. However, the actuating pressure is preferably in excess of the static pressure exerted at the opening pressure valve's position so as to prevent opening of the valve merely in response to the static pressure of liquid in the lines. It will be appreciated that only one valve may be required. For example, in a situation where there is a bar located on two floors, a pressure equalising valve is only required on the ground floor with the actuating pressure equating to the pressure owing the difference in height between the two floors. In one implementation, the valve is a valve which opens in response to a predetermined pressure 22. The valve is positioned in the drainage hose between the inlet and the outlet. The valve is configured to open at a positive pressure i.e. positive gauge pressure and acts as a check valve to prevent back flow. The valve opens at positive pressure value that is in excess of the static pressure exerted at the valve's position when there is no delivered supply of detergent or rinse water from the source 18. This prevents liquid draining out of the drainage hose and keeps detergent solution in contact with the internal surfaces of the beverage conduit and beverage tap. As different actuating pressures will be required, a plurality of different drainage conduits may be made available each with a different actuating pressure. Similarly, the valves may be adjustable.

In one embodiment a plurality of drainage hoses are used with a plurality of beverage taps. FIG. 2 and are two possible configuration where there are more than one serving locations 2 supplied by a single beverage storage area 4. The valves 22 are configured to open at pressure values such that they substantially equalise the flow resistance or back pressure produced by each beverage conduit connected to the inlet manifold. The effect of the valve is to substantially equalise the flow of liquid through the beverage conduits connected to the different serving locations.

For example in the configuration described in FIG. 2, when the conduits are full of liquid and connected to the common manifold, the beverage taps in the ground floor dispense area $\mathbf{4}_g$ have a static pressure head difference from the beverage taps on the 1st floor $\mathbf{4}_1$. This results from the lower height of the ground floor beverage taps from the 1st floor beverage taps. Depending on the height difference this could be between 200-400 hPa corresponding to a height of 2.1-4.1 m. Although, it will be appreciated that in certain installations, that dispense taps may be positioned at heights lower than or greater than this. In practise, therefore an operating range to provide for is a difference in height of 1-6 m.

To facilitate ease of use, different colours or other markings may be made to identify different drainage hoses for different dispense taps.

The static pressure head at the valve in a drainage hose 26 connected to the ground floor beverage tap is higher (by approximately 20-40 hPa) because of the lower level of its position. The static pressure head at the valve in the drainage hose connected to the $1^{st}$ floor beverage taps is the result of its height difference below the beverage tap i.e. 20-40 hPa (usually the highest point in the beverage conduit). By configuring the valves in the drainage hoses so that they open at pressures in excess of the static head pressure at the two different levels, liquid is both retained in the beverage conduits under static conditions and also the flow resistance of the different conduits is substantially equalised when flowing liquid through the conduits to the dispense areas at the two different levels. In addition using components that act as check valves stops back flow of liquid from the conduits supplying the $1^{st}$ floor dispense area to the ground floor dispense area when liquid in not flowing from the cleaning system 18.

In another example using the configuration shown in FIG. 3 with a $2^{nd}$ floor beverage storage area, the valves in the drainage systems on the ground floor are subjected to a static head pressure corresponding to the height of the liquid above its position of approximately 475-800 hPa (4.9-8.2 m). The valve on the $1^{st}$ floor is subjected to a static head pressure of approximately 200-400 hPa (2.1-4.1 m). Again using suitable opening pressures for the valves to be in excess of the static head pressure, liquid is retained in the beverage conduits and beverage taps when no liquid is flowing and the flow of liquid through the beverage conduits is substantially equalised when it is being supplied to the cleaning manifold. In addition using components that act as check valves stops potential siphoning of liquid from the conduits supplying the $1^{st}$ floor dispense area to the ground floor dispense area.

It will be understood, that the valves 22 may be selected or configured to open at pressure values such that they substantially equalise the time taken to fill each beverage conduit connected to the inlet manifold with either detergent solution or rinse water. This allows lines to be more efficiently filled with detergent solution and rinsed with water as the beverage conduits with the smaller volume take similar time to fill as the larger volume conduits.

Figure 1:
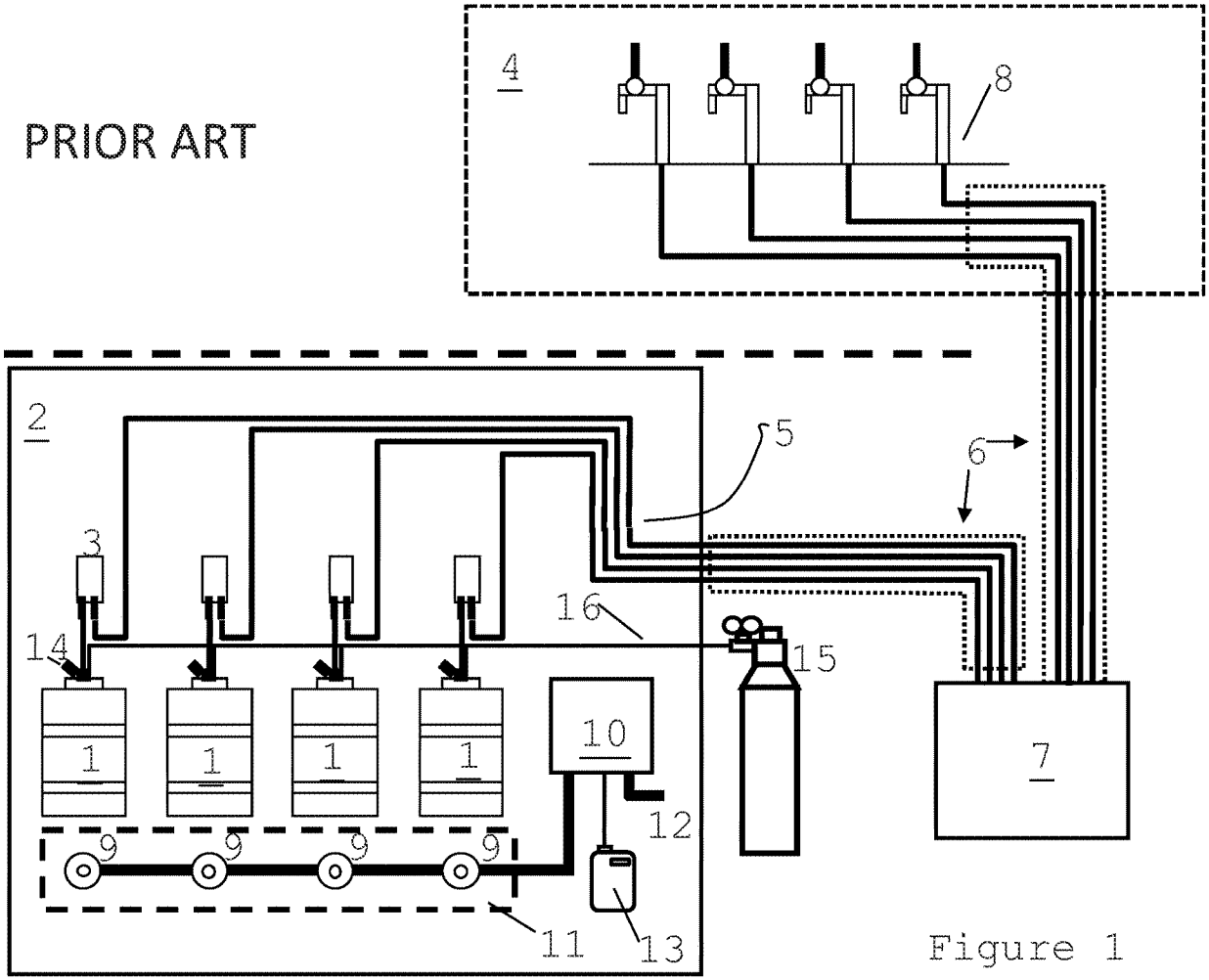
FIG. 1 is an exemplary beverage dispense system known in the art.

The cleaning operation may be semi-automated by using a plurality of the previously described drainage hoses in combination with a control means e.g. a microcontroller or process logic controller (PLC) to operate the supply of detergent solution and rinse water 18. A flowmeter may be provided to provide a measure to the control means of the fluid delivered to the beverage conduits. The system may be regarded as semi-automated since a user is still required to connect the drainage hoses to the dispense taps. An example of a suitable system would be that provided for in FIG. 1, albeit with the incorporation of the above described pressure equalising features.

Whilst, the incorporation of the pressure equalising feature in the drainage hose offers several advantages, it will be appreciated that the pressure equalising feature may be positioned elsewhere.

Thus in one embodiment, the valve is positioned in the beverage conduit in proximity to the beverage tap. This eliminates the need to use specific drainage hoses on beverage taps in a specific dispense area.

Figure 5:
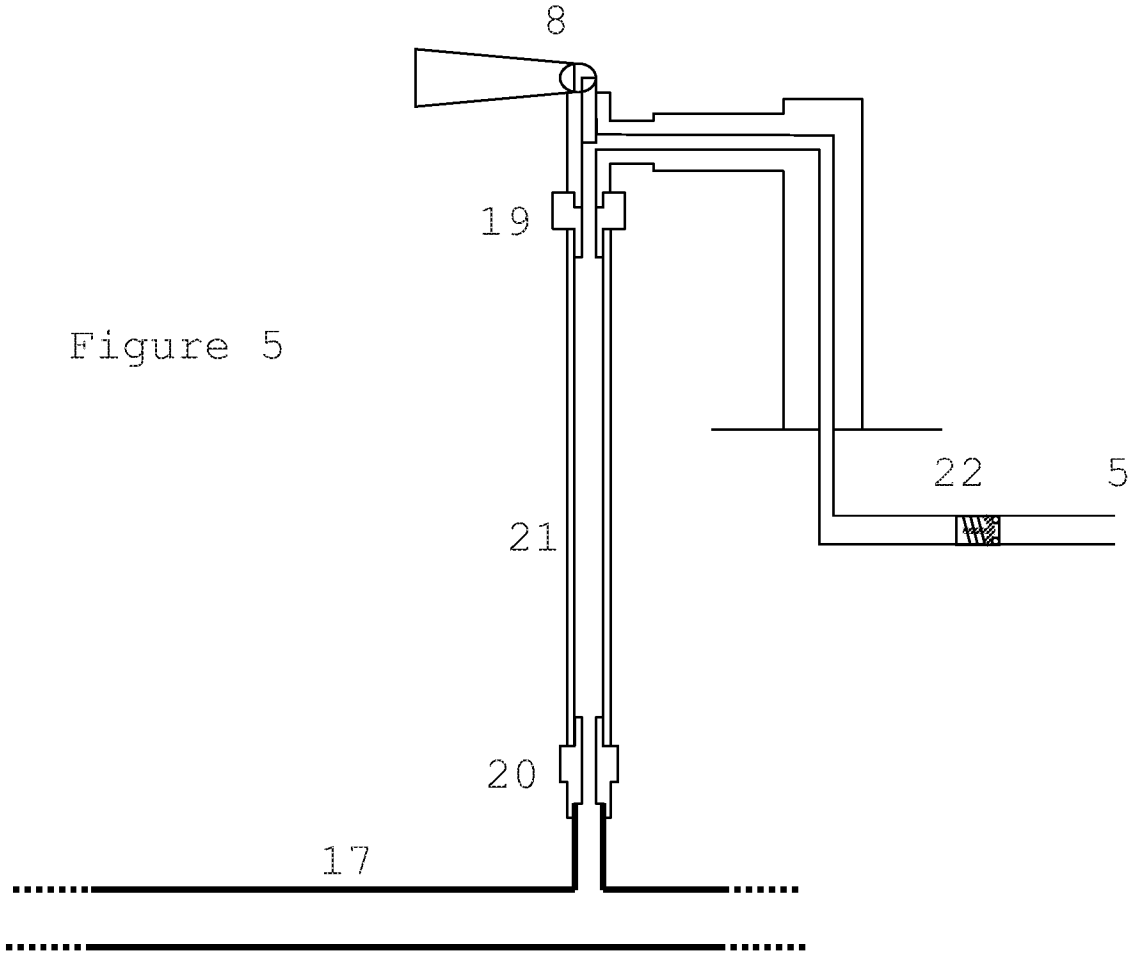
FIG. 5 is an exemplary drainage conduit according to an embodiment of the present application in which the pressure equalising feature is positioned in the beverage conduit.

FIG. 5 shows one possibility for this configuration. In some installations more than one beverage conduit may be supplied by a single beverage storage container. In this scenario, the conduits are typically connected downstream of the FOB. By including the valve, both dispensed beverage and the cleaning process benefit from the substantial equalisation in the flow. A still further embodiment integrates the valve within the beverage tap.

In some arrangements, the outlet end of the drainage hose is simply placed in a sink in the bar allowing the waste beverage and cleaning solution to enter the drain system through the waste water outlet of the sink. In other arrangements, a connection is provided to connect the hose to the drain system. In this arrangement, the connection will have a suitable feature for engaging with the end of the drainage hose and retaining it in place. It will be appreciated that in such arrangements, the previously discussed valve may be integrated within the connection to the drain.

In this approach, the drainage conduit then comprises two parts, the first, which is removable, is the drainage hose and the second, which suitably but not necessarily so remains in place, is the connection to the drain. The advantage of this approach is that the drainage hoses do not need to be unique since the valve is in situ in the connection to the drain. It will be appreciated that in this arrangement, the hoses are interchangeable and do not need to be uniquely associated with each dispense tap or floor of the establishment.

Another advantage of the two part drainage conduit is that in certain bars the drain or sink may not be immediately accessible from the beverage tap. As a result, the length of drainage conduit required to connect a beverage tap to a drain might be unduly long. Additionally, depending on the configuration in the bar, the drain itself may not be immediately accessible. In either case, it will be appreciated that relatively long hoses may be required which may be cumbersome to use by a user.

The separation of the drainage conduit into two parts (sections) provides a solution to these problems. More particularly, by splitting the drainage conduit into a fixed part which is installed in-situ in the bar and provides a connection between the drain and a connector. The fixed part may be a flexible hose as described above which connects to a drain at one end and provides a connector at the other. The fixed part may be held in situ using conventional fasteners, such as for example, pipe clips and cable ties.

The connector may be a conventional male or female hose connector. The connector may be of a push fit, snap fit, twist fit or similar configuration. The fixed part may be routed behind paneling in a bar with only the connector exposed to facilitate a connection. The connector may be positioned relatively close to beverage tap.

The second part of the drainage conduit is suitably removable. The removable part is suitably also a flexible hose of the type described generally above and allows a connection to be made between the beverage tap and the connector of the fixed part.

If the connector on the fixed part is a male connector the connector on the hose will be a co-operating female connector and vice versa.

By separating the drainage conduit into two parts, users need only concern themselves with connecting the removable part from the beverage tap to the connector of the fixed part. This means that the user can work with the removable part which may be significantly shorter than the total length of the drainage conduit.

It will be appreciated that to obtain the pressure equalising advantage described above, the pressure equalising valve may be positioned in either of the fixed part or the removable part. Indeed, it will be appreciated that a valve might be located in each of the removable and fixed parts provided that the combined actuating pressure of the two valves equated to the required overall pressure equalising value.

The advantage of the systems described herein over prior art systems is that the cleaning of multiple beverage conduits may be achieved in parallel by allowing efficient and reliable filling of the beverage conduits with detergent solution and subsequently rinsing same with water. The system does not rely on complex and expensive control electronics and sensors to ensure conformance to the cleaning process. In this context, several beverage taps at the same bar may be commonly connected by a single drainage conduit to the drain.

In such an arrangement, a plurality of tap connection sections may be provided at one end of the drainage conduit. Each of the tap connection sections may be used to connect to a different beverage tap at a first end. At the second end, each of tap connection sections may be commonly connected to a drain section which goes to the drain. The common connection may be integrally formed or there may be a connector arrangement allowing for tap connection sections to be removed or connected as required. In such an arrangement, each of the connecting parts on the drain section may be suitably provided with a valve closing the connecting part in the event that a tap connection section is not connected to it. This simply prevents liquid flowing out from an unconnected connection rather than into the drain.

It will be appreciated that in order to obtain the pressure equalising advantage described above, the pressure equalising valve may be positioned in either of the tap connection sections or the drain connection section. Indeed, it will be appreciated that a pressure equalising valve might be located in each of the tap connection sections and the drain connection section provided that the combined actuating pressure of the valve positioned in each tap connection section and the actuating pressure of the valve in the drain connection section equate to the pressure required overall for the pressure equalising value.

Equally, it will be appreciated that the described two part drainage conduit may be combined with the arrangement in which multiple taps are commonly connected. In such an arrangement, the fixed part might provide a plurality of connectors allowing a plurality of removable parts coming from beverage taps to be commonly connected. As before, the only demand when determining where a valve or valves are to be positioned in the overall arrangement is that the pressure on each beverage dispensing line is effectively equalised with the others.

Figure 6:
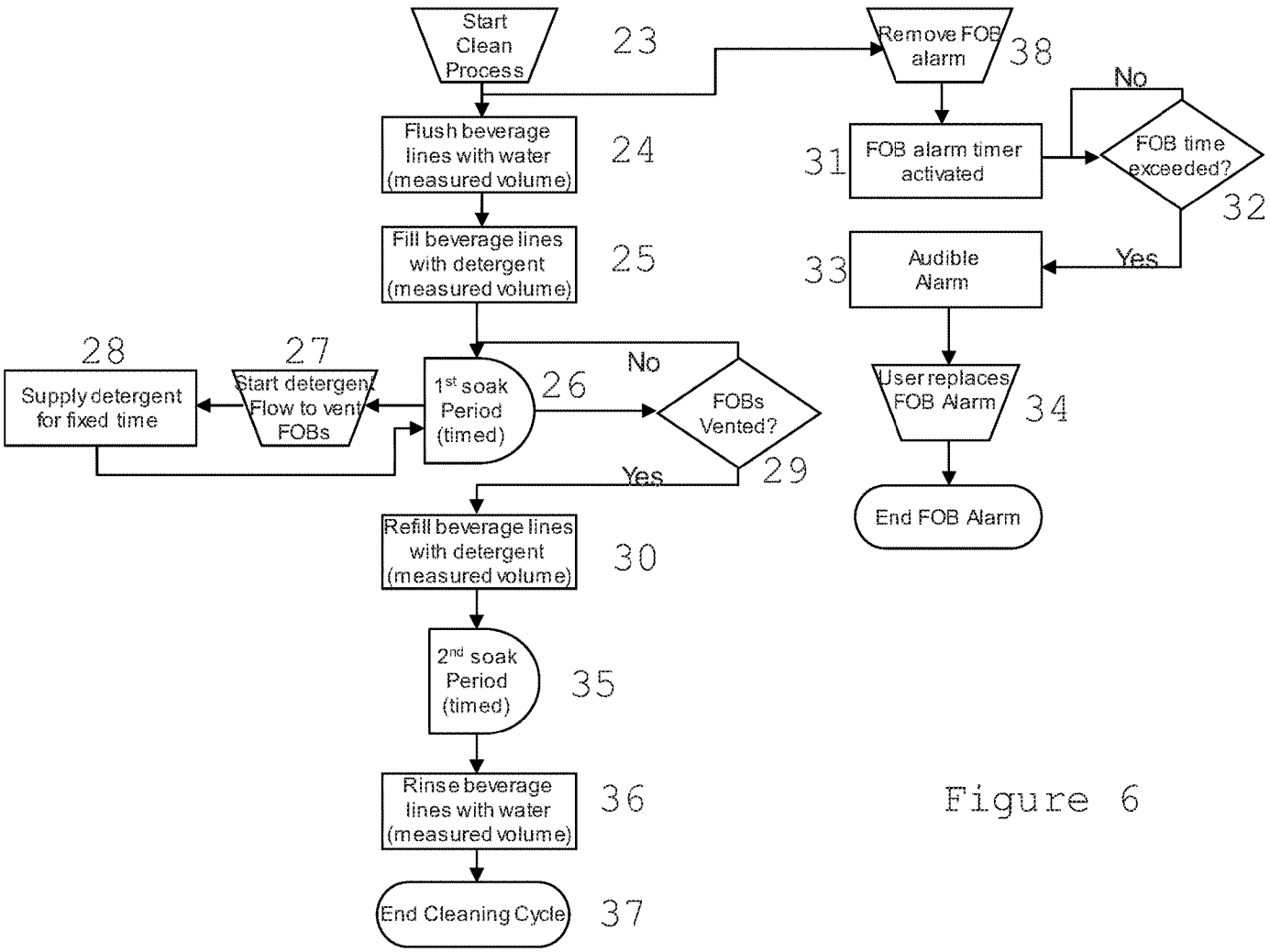
FIG. 6 is a flowchart for the operation of a exemplary line cleaning process. The process incorporates the step of responding to an alarm signal by operating the line cleaning system to allow venting of the FOBs. This step is suitably completed before the process progresses further.

An exemplary process using the previously described embodiments is described by the flowchart in FIG. 6. A user connects up the dispense heads of the beverage conduits 6 to be cleaned to the cleaning ring-main 11 and the corresponding beverage taps 8 to the drainage hoses 26. Starting the cleaning process 23, the automatic line cleaning system 18 supplies a measured quantity of water to flush 24 any residual beverage from the beverage conduits. This ensures that detergent does not react with residual beverage, reducing its effectiveness. The next process step fills the beverage conduits with a volume of detergent solution 25. The volume may be predetermined for the installation, e.g. by the time required for detergent to arrive at all of the taps. The valves ensure that the flow of liquid through each of the beverage conduits is substantially similar so that they are efficiently charged with detergent solution. When the beverage conduits are filled with detergent solution the automated line cleaning system stops delivering detergent and waits 26 for the chemicals to react with the contamination on the inside of the beverage conduits.

When dispense heads are disconnected from the beverage storage containers and connected to the cleaning manifold, air and dispense gas can enter the conduits. The FOBs act as a bubble trap and as a result these may not completely fill with detergent solution when it is being supplied by the automatic line cleaning system. To ensure that they are properly cleaned it is necessary for a user to vent this air and gas from the FOB. In order to do this there must be a positive pressure inside the FOB. The valve also acts as a check valve which limits liquid flowing back down the beverage conduit into the FOB during a soak period when the beverage storage area is below the level of the dispense area. The valves also stop air ingress when attempting to vent a FOB during the soak period when the beverage storage area is above the dispense area.

To vent the FOBs effectively detergent solution must be supplied by the automatic line cleaning system. This is achieved by the user manually activating 27 the automatic line cleaner for this purpose. The line cleaning system provides flowing detergent solution for a fixed time 28 during which the user can vent the FOBs. If more time is required the function may be reactivated. The automatic line cleaning process includes a check 29 that this function has been activated before it will proceed to the next step in the process.

Figure 7:
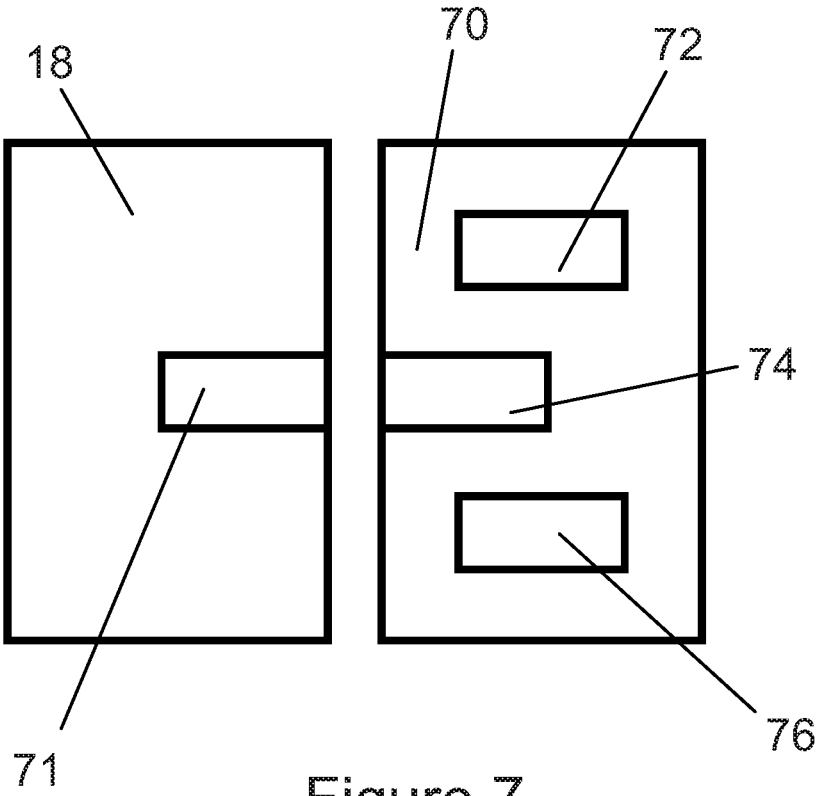
FIG. 7 is an exemplary portable fob alarm device.

In order to ensure the correct completion of the process a portable FOB alarm device 70, as illustrated in FIG. 7, is provided with the previously described beverage conduit cleaning system 18 although it may also be used with other line cleaning systems. The portable alarm device 70 suitably comprises a timer 76 and an alarm 72. The alarm 72 is activated by the timer 76 after the elapse of a predetermined time from a triggering event. The alarm device is removable from the beverage cleaning system and the triggering event is the detection of the removal of the portable alarm from the beverage conduit cleaning system. It will be appreciated that a variety of sensors may be employed to detect the removal of the portable alarm device. For example, the sensor may simply detect the presence of an electrical connection which is present when the alarm is attached to the cleaning system. Similarly, the sensor 74 may be a magnetic sensor which is actuated by a magnet 71 provided on the cleaning system. Equally, it will be apparent to those skilled in the art that other techniques and sensors may be used to determine when the portable alarm device has been removed.

The portable alarm device suitably provides an audible alarm. Alternatively, or in addition to the audible alarm a visible alarm may be provided. The portable alarm is normally situated with the automatic line cleaning system. At the start of the process, when the installation has been set-up for cleaning, the user removes 38 the portable alarm from the automatic line cleaning system. Removing the FOB alarm activates a timer 31. After a fixed period of time 32, when the line cleaning process is in the 1$^{st}$ soak period, an audible alarm is activated. This is to prompt the user to return and complete the FOB venting process. The alarm may be deactivated by replacing it on the line cleaning system 34.

Once the user has completed venting the FOBs the cleaning process continues without any further manual intervention. The beverage conduits are refilled with a measure volume of detergent solution 30 to replace the solution that has reacted with the material in the contaminated beverage conduits. The detergent solution soaks for a second fixed time period 35 and is then rinsed with a fixed volume of water 36. The process then completes 37. This process requires the user to start the cleaning cycle on the automatic line cleaning system and make manual intervention at one point in order to vent the FOBs and ensure proper cleaning of all the components in the beverage conduit.

A further advantage of the present system is that by ensuring that each beverage line receives the correct amount of cleaning solution, the volume of cleaning solution used may be optimised and waste avoided. Additionally, the time required for cleaning may be reduced to an optimal value since there is no need to compensate for poor cleaning performance which may have been experienced with existing systems.

It will be appreciated that whilst several different embodiments have been described herein, that the features of each may be advantageously combined together in a variety of forms to achieve advantage.

In the foregoing specification, the application has been described with reference to specific examples of embodiments. It will, however, be evident that various modifications and changes may be made therein without departing from the scope of the invention as set forth in the appended claims. For example, the fluid conduits, e.g. pipes and lines, may be any type of conduit suitable to transfer a fluid one location to another.

Other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps than those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or an limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A cleaning system for use in cleaning a beverage dispensing system, the cleaning system comprising a plurality of beverage dispensing conduits, each beverage dispensing conduit having a source of beverage at a first end and a dispenser at a second end opposite the first end, the cleaning system further comprising:

a plurality of drainage conduits for connecting respective dispensers to a drain, each drainage conduit comprising:

an inlet provided at one end of the drainage conduit for connecting to the respective dispenser of the beverage dispensing system, an outlet provided at an opposite end of the drainage conduit to the inlet, and a valve positioned between the inlet and outlet of the drainage conduit, wherein the valve is configured to open at a respective preset pressure to provide fluid communication between the inlet and the outlet;

wherein a respective valve of each of the plurality of drainage conduits is configured to open when the respective preset pressure of the respective valve is reached.

2. The cleaning system of claim 1 wherein the inlet is configured to engage with corresponding features of the dispenser in the beverage dispensing system.

3. The cleaning system of claim 2, wherein the inlet and the dispenser in the beverage dispensing system co-operate to provide one of:

a) a screw fit, b) a push fit, or c) a snap fit.

4. The cleaning system of claim 1, wherein the valve is a one way valve preventing flow of the beverage from the outlet of the drainage conduit to the inlet of the drainage conduit.

5. The cleaning system of claim 1, wherein the outlet of the drainage conduit is configured for connection to one of a drain or a receptacle.

6. The cleaning system of claim 1, wherein the drainage conduit is a flexible tube having an inner bore and the valve is disposed within said inner bore.

7. The cleaning system of claim 1, wherein the drainage conduit comprises a flexible tube and a drain connection, wherein the flexible tube is provided at the end of the drainage conduit having the inlet and the drain connection is provided at the end of the drainage conduit having the outlet.

8. The cleaning system of claim 7, wherein the flexible tube and drain connection are removably connectable.

9. The cleaning system of claim 7, wherein the valve is provided in the drain connection.

10. The cleaning system of claim 1, further comprising a source of cleaning solution connected to the first end of the beverage dispensing conduit.

11. The cleaning system of claim 1, further comprising a flowmeter and a controller for the source of cleaning solution.

12. The cleaning system of claim 1, wherein each of the plurality of drainage conduits is connected to a respective dispenser.

13. The cleaning system of claim 1, further comprising a portable alarm device, the portable alarm device comprising: a timer and an alarm, wherein the alarm is configured to be activated after a predetermined time set by the timer in response to a triggering event, and wherein the alarm is removable from the cleaning system and the triggering event is the detection of the removal of the portable alarm device from the cleaning system.

14. The cleaning system of claim 13, wherein the portable alarm device further comprises a sensor for detecting removal of the portable alarm device from the cleaning system.

15. A cleaning system for use in cleaning a beverage dispensing system, the cleaning system comprising a plurality of beverage dispensing conduits, each beverage dispensing conduit having a source of beverage at a first end and a dispenser at a second end opposite the first end, the cleaning system further comprising:

a plurality of drainage conduits for connecting a dispenser to a drain, each drainage conduit comprising:

an inlet provided at one end of the drainage conduit for connecting to a respective dispenser of the beverage dispensing system, an outlet provided at an opposite end of the drainage conduit to the inlet, and a valve positioned between the inlet and outlet of the drainage conduit and configured to open at a preset pressure to provide fluid communication between the inlet and the outlet;

wherein a first group of drainage conduits comprise valves configured to open at a first preset pressure and a second group of drainage conduits comprise valves configured to open at a second preset pressure.

16. The cleaning system of claim 15 wherein the first group of drainage conduits are located at a first location and the second group of drainage conduits are located at a second location.

17. The cleaning system of claim 16, wherein the first and second locations are on different floors within a building.

18. A cleaning system for use in cleaning a beverage dispensing system, the cleaning system comprising a plurality of beverage dispensing conduits, each beverage dispensing conduit having a source of beverage at a first end and a dispenser at a second end opposite the first end, the cleaning system further comprising:

a first drainage conduit for connecting a first dispenser to a drain, said first drainage conduit comprising:

an inlet provided at one end of the drainage conduit for connecting to a respective dispenser of the beverage dispensing system, an outlet provided at an opposite end of the drainage conduit to the inlet, and a valve positioned between the inlet and outlet of the drainage conduit and configured to open at a preset pressure to provide fluid communication between the inlet and the outlet;

further comprising a second drainage conduit for connecting a second dispenser to a drain, the second drainage conduit not having a valve positioned between the inlet and outlet such that said valve in the first drainage conduit compensates for a pressure differential between the first and second dispensers.

19. A method of cleaning a beverage dispensing system comprising at least a first beverage dispensing conduit and a second beverage dispensing conduit, each of the first and second beverage dispensing conduits providing beverage from a respective source to a respective dispenser, the method comprising:

connecting a drainage conduit comprising a pressure actuated valve to at least one respective dispenser said pressure actuated valve compensating for a pressure differential between the first and second beverage dispensing conduits;

connecting a source of cleaning solution to an end of each of the first and second beverage dispensing conduits at an end opposite to the end of the beverage dispensing conduits connected to the dispensers; and opening each of the first and second dispensers.

* * * * *